United States Patent [19]

Zeiss

[11] Patent Number: 4,772,243

[45] Date of Patent: Sep. 20, 1988

[54] CHILD'S TOY OVEN WITH ACCESS DOOR SAFETY LATCH

[75] Inventor: Ernest Zeiss, Lombard, Ill.

[73] Assignee: G. Pierce Toy Manufacturing Company, Chicago, Ill.

[21] Appl. No.: 41,836

[22] Filed: Apr. 23, 1987

[51] Int. Cl.[4] ..... A63H 3/52; E05H 11/00; F23M 7/00; E05C 3/16

[52] U.S. Cl. ..... 446/481; 49/300; 49/449; 126/191; 292/227; 292/DIG. 46

[58] Field of Search ..... 446/481, 479, 480, 476; 126/191, 192, 197; 292/DIG. 46, 227, 202; 49/300, 449, 445, 414

[56] References Cited

U.S. PATENT DOCUMENTS

| | | | |
|---|---|---|---|
| 274,658 | 3/1883 | Rees et al. | 292/DIG. 46 X |
| 489,291 | 1/1893 | Doran | 292/DIG. 46 X |
| 910,465 | 1/1909 | Faulds | 126/192 |
| 1,102,221 | 6/1914 | Whitford et al. | 292/DIG. 72 X |
| 1,185,422 | 5/1916 | Mammelli | 292/227 |
| 1,515,905 | 11/1924 | Sokolow | 292/227 |
| 2,120,327 | 6/1938 | Elsaesser | 49/445 X |
| 2,784,019 | 3/1957 | Des Combes | 292/DIG. 46 X |
| 3,077,631 | 2/1963 | Erck | 49/445 X |
| 3,091,797 | 6/1963 | Prosser | 49/445 X |
| 4,563,573 | 1/1986 | Hartelius et al. | 126/192 X |

FOREIGN PATENT DOCUMENTS

| | | | |
|---|---|---|---|
| 2039759 | 8/1980 | United Kingdom | 446/481 |

*Primary Examiner*—Richard J. Johnson
*Assistant Examiner*—D. Neal Muir
*Attorney, Agent, or Firm*—Allegretti & Witcoff, Ltd.

[57] ABSTRACT

A child's toy oven comprises a housing having a baking chamber therein. An access opening is provided in a wall of the housing for communicating with the baking chamber. A slidable access door is positioned on a wall of the housing to open and close the access opening. A latch cooperates with the access door to prevent inadvertent opening of the slidable access door. The latch is pivotally secured on the access door and a stop shoulder on the housing is adapted to engage the latch to retain the access door in position closing the access opening. A spring is positioned between the latch and the access door for biasing the latch into position for engagement with the stop shoulder to preclude movement of the access door to unblock the access opening. A tray actuator external of the housing is provided to engage the latch to release it from engagement with the stop shoulder to permit movement of the access door by the tray to open the access opening and allow the tray to enter the baking chamber. The tray is a spatula-like member having a base and side walls complementary in shape to the access opening such that when the member is used to release the latch and permit the member to be inserted into the housing, the member will block the access opening to preclude entry of unwanted foreign objects into the baking chamber.

8 Claims, 2 Drawing Sheets

Fig. 4
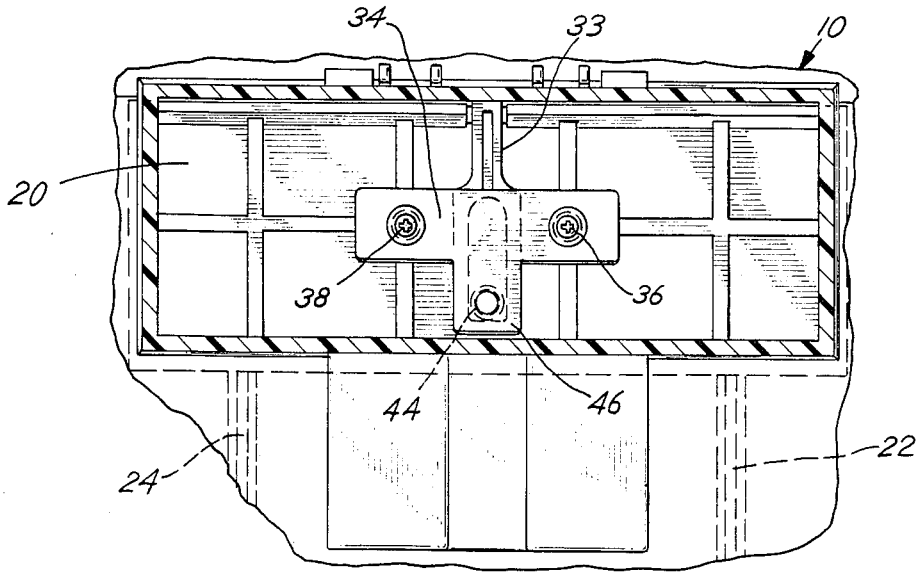
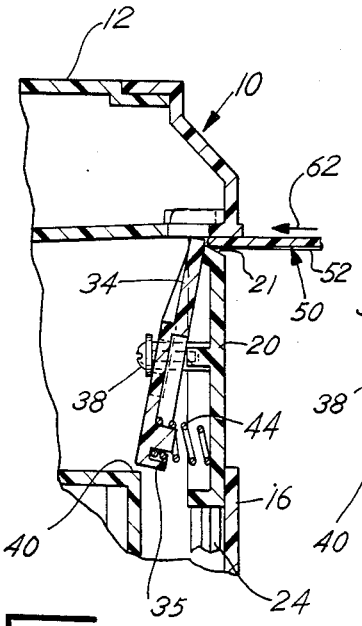
Fig. 5
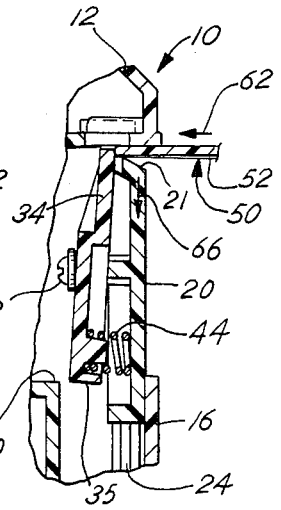
Fig. 6
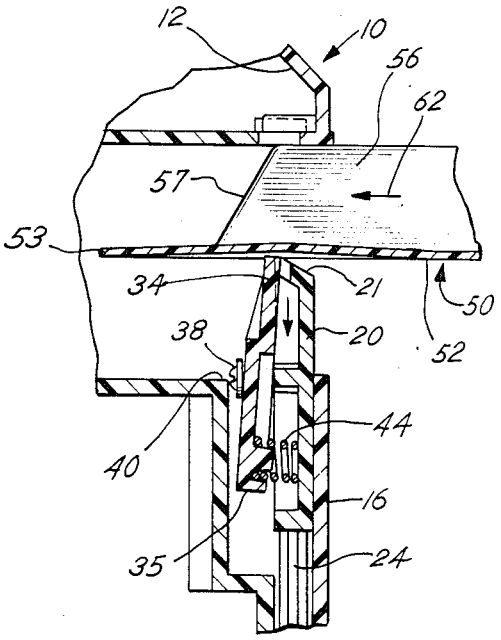
Fig. 7

CHILD'S TOY OVEN WITH ACCESS DOOR SAFETY LATCH

BACKGROUND OF THE INVENTION

This invention relates to a heating appliance and more particularly, to a child's toy oven having safety latch means for precluding inadvertent opening of an access door to the heated baking chamber within the toy oven. Further, the safety latch means is actuated by actuating means which substantially fills the access opening in use to preclude the user from inserting a finger or other undesirable object into the baking chamber.

In the past, toy ovens having a housing with a heated baking chamber have been known. Such ovens have an access door which may be opened to permit material to be baked to be inserted into the baking chamber. The source of heat may be a light bulb within the baking chamber. Ordinarily, to bake a comestible, such as a cookie or cookies, the dough is placed on a try. The access door is opened. The tray is placed in the baking chamber. The door is closed and a switch in circuit with the light bulb is closed to turn on the light bulb and provide sufficient heat to bake the cookie. After the cookie is baked, the access door is opened and the cookie is removed. Such known toy ovens did not have latching means for assuring that the door could not be inadvertently opened when the baking chamber was being heated.

An object of the present invention is to provide an improved toy oven having a housing with a baking chamber therein and an access opening to the baking chamber in a wall of the housing, with an access door for opening and closing the access opening, latch means for retaining the access door in closed position, and actuating means external of the housing for engaging and releasing the latch means to permit opening of the access door.

Another object of the present invention is to provide an improved toy oven with an access door having a safety latch to preclude unintentional opening of an access opening to a heated baking chamber within the toy oven.

Yet another object of the present invention is to provide an improved toy oven with an access door having a safety latch to prevent inadvertent opening of the access door and actuating means operable externally of the housing for the toy oven for releasing the safety latch to permit movement of the access door to open the access opening, but substantially blocking the access opening to preclude entry of foreign objects into the baking chamber within the toy oven. These and other objects and advantages of the present invention will be made more apparent hereinafter.

DESCRIPTION OF THE DRAWING

There is shown in the attached drawing a presently preferred embodiment of the present invention wherein like numerals refer to like elements in the various views, and wherein:

FIG. 4 is a detailed rear view of the access door and safety latching means therein taken generally along line 4—4 of FIG. 3;

FIG. 5 is a detailed cross-sectional view illustrating the initial insertion of the actuating member into the access opening;

FIG. 6 is a detailed cross-sectional view illustrating the actuating member engaging the safety latch and moving same to a release position so as not to engage the stop shoulder on the housing; and FIG. 7 is a detailed cross-sectional view similar to FIG. 4 illustrating the access door moved to open position and the actuating member in position within the access opening substantially precluding the introduction of a foreign object through the access opening into the baking chamber.

DETAILED DESCRIPTION OF THE PRESENT INVENTION

Figure 1:
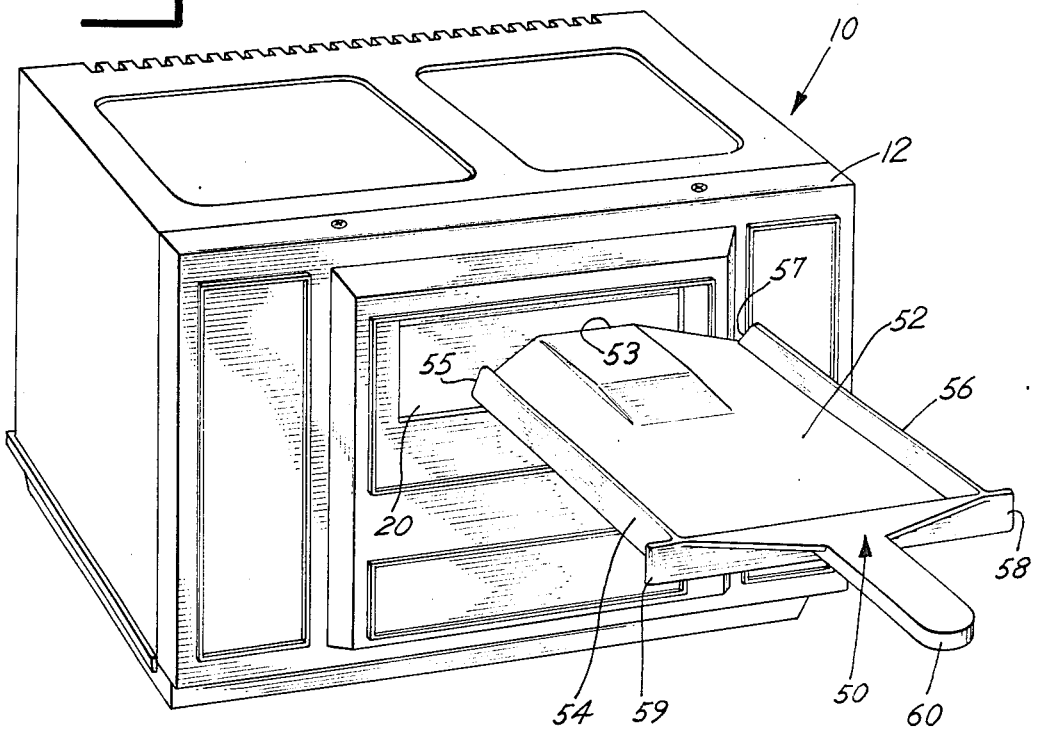
FIG. 1 is a perspective view of a toy oven embodying the present invention and illustrating the actuating means about to be inserted into the toy oven in order to open the access door.

There is shown in FIGS. 1-4 a toy oven 10 embodying the present invention. The toy oven 10 is a heating appliance resembling a microwave oven. The toy oven 10 comprises a housing 12 having a baking cavity or chamber 14 defined therein for baking a product, such as a cookie. The source of heat for the baking chamber 14 may be a light bulb (not shown).

The front wall 16 of the housing 12 has an access opening 18 therein for permitting communicatiin with the baking chamber 14 from external of the housing 12. The access opening 18 is adapted to be opened and closed by an access door 20 slidably supported on wall 16 of housing 12.

Figure 3:
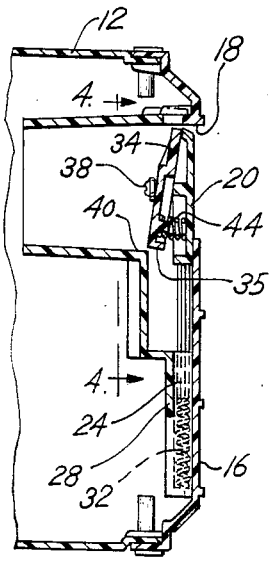
FIG. 3 is a detailed cross-sectional view taken generally along the line 3—3 of FIG. 2.
Figure 2:
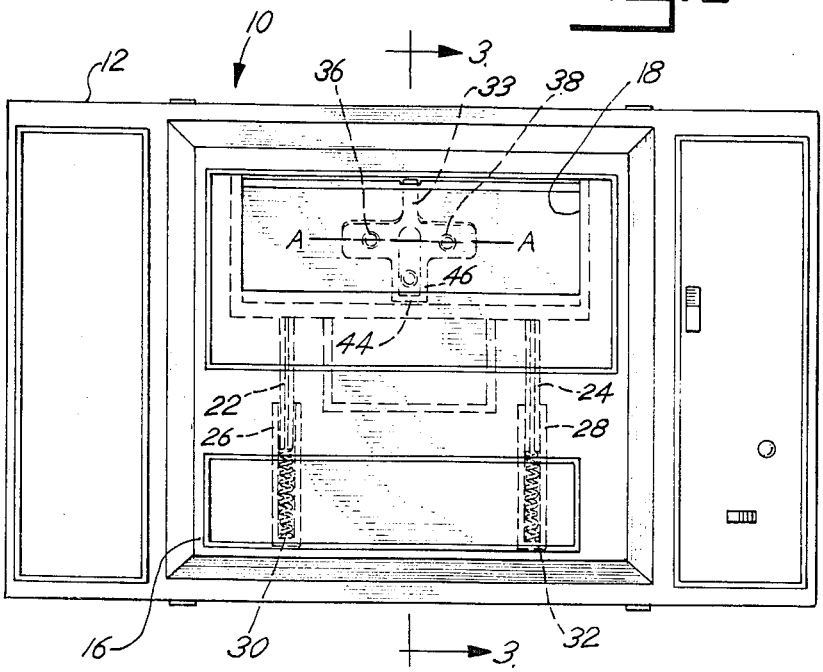
FIG. 2 is a front elevational view of the toy oven.

The access door 20 is complementary in shape to the access opening 18 and slightly larger than the access opening to completely block the access opening 18 when the access door 20 is closed. Depending from the access door 20 are two rod-like supports 22, 24 slidably carried within hollow guides 26, 28 on the housing 12. Springs 30, 32 are provided between the supports 22, 24 and the guides 26, 28 to bias the access door 20 to the closed position, as shown in FIG. 3.

Latching means are provided for preventing inadvertent opening of the access door 20. The latching means comprise a latch 34 pivotally carried on the access door 20 by screw means 36, 38. The screw means 36, 38 pass through holes in the access door 20 which have a diameter slightly larger than the outside diameter of the screw of the screw means so as to permit pivotal movement of the access door 20 with respect to the screw means. Preferably the screw means 36, 38 each comprise a screw threaded into or otherwise joined to the door 20 and a washer between the latch and the head of the screw. A surface 35 of the latch 34, which is generally in the shape of a cross and pivoted about an axis A—A (FIG. 2) through the screw means 36, 38, is adapted to engage a stop shoulder 40 on the housing 12. Spring 44 is disposed between the access door 20 and the lower part 46 of the latch 34 to bias the latch 34 into position to engage the stop shoulder, as shown, for example, in FIG. 3. The spring 44 may be a coil spring, as shown.

Actuating means 50 are provided for engaging the top of the upright portion 33 of the latch 34 to position the latch 34 out of alignment with the stop shoulder 40 in the housing 12 to permit movement of the access door 20 by the actuating means to open the access opening and enable the actuating means to enter the baking chamber. The actuating means 50 comprises a spatula-like member having a base 52 adapted to support a product to be baked, e.g., a comestible such as a cookie, side walls 54 and 56, a rear wall 58, and a handle 60 extending from the rear wall. As will be made more apparent hereinafter, the actuating means 50 is complementary in shape to the access opening 18 in housing 12 such that when the actuating means 50 is operated to release the latch 34 and permit the door 20 to be opened, the actuating means 50 will substantially fill and block the access opening 18 to preclude entry of foreign objects into the heated baking chamber 14. For example, a child using the toy oven 10 could not insert his fingers or other object into the baking chamber 14 when the access door 20 is open and the actuating means 50 has been inserted through the access opening 18 into the baking chamber 14 to permit baking of the product on the base of the actuating means.

Turning to FIGS. 5–7, there is better shown the cooperation between the actuating means 50 and the latch 34. With reference to FIG. 5, when the toy oven 10 is not being used, the springs 30, 32 cooperate with the supports 22, 24 for the door 20 and bias the door 20 to the closed position. Spring 44 biases or urges the lower part of the latch 34 rearwardly so that it is in position to engage stop shoulder or stop surface 40 in housing 12 if door 20 should be urged downwardly against the bias of springs 30, 32.

The top edge of latch 34 normally extends above the top edge of door 20, i.e., when the door 20 is biased closed and the actuating means 50 is not being used. Thus, there is normally a small space between the top edge of door 20 and the top surface defining access opening 18. In order to release the latch 34 to permit opening of door 20, the leading edge 53 of base 52 of the actuating means 50 is moved in the direction of the arrow 62 in FIG. 5. The leading edge 53 is guided by incline 21 on the top surface of door 20 to contact latch 34 and pivot the latch 34 about an axis A—A extending through the screws 36, 38.

The latch 34 will be pivoted to a position where the lower surface 35 of latch 34 will not contact stop shoulder 40 when the latch 34 is moved downwardly, as seen in FIG. 6. The door 20 will be forced or cammed downwardly by the actuating means 50, as shown by the arrow 66 in FIG. 6 as the actuating means 50 is inserted into the housing 12. Spring 44 is compressed at this time.

As the actuating means 50 is pushed inwardly, the inclined surface 55, 57 of the side walls 54, 56 will engage the top surface defining the access opening 18 and force or cam the door 20 downwardly as shown in FIG. 7. The actuating means 50 are inserted inwardly until the outwardly extending ends or extremeties 59 of wall 58 contact the front surface of front wall 16. A switch (not shown) in circuit with the heating source may be actuated to heat the baking chamber 14 and bake the product on the base 52 of the actuating means 50. The top surface of the side walls 54, 56 are in engagement with the top surface defining the access opening 18. The exterior surfaces of side walls 54, 56 are in close proximity to the side surfaces defining the access opening 18. The rear wall 58 extends beyond the sides defining access opening 18 and the side extremities 59 of wall 58 function as stops to limit movement of the actuating means 50 inwardly. The top of upright portion 33 of the latch 34 engages the bottom of base 52 of the actuating means 50 and springs 30, 32 bias the door 20 upwardly to keep the top of latch 34 in contact with the base 52 of the actuating means 50. Thus, when the actuating means 50 is fully inserted into the access openingg, entry of foreign objects into the baking chamber 14 from external of the housing 12 is precluded. A child using the toy oven cannot insert a finger or other undesirable object into the baking chamber.

When the actuating means 50 is withdrawn from the toy oven 10, the door 20 will be biased closed.

There has been provided by the present invention a unique access door safety latch for a toy oven that is simple and reliable in use. The safety latch cooperates with actuating means to permit opening of the access door when desired, but precludes entry of undesirable objects into the heated baking chamber when it is in use to bake product on the actuating means.

While I have shown a presently preferred embodiment of the present inventiion, it will be understood by persons skilled in the art, that it may be otherwise embodied within the scope of the appended claims.

I claim:

1. In a heating appliance comprising a housing with a baking chamber defined therein, an access opening defined in a wall of the housing for communicating with the baking chamber, and a door on said wall of said housing for opening and closing the access opening to the baking chamber, the improvement comprising a latching means for preventing inadvertent opening of the door, said latching means comprising a latch pivotally secured on the door and a stop shoulder on said housing adapted to be engaged by said latch to retain the door in a closed position, a spring disposed between the latch and the door for biasing the latch into engagement with the stop shoulder to preclude opening of the door, and actuating means external of the housing for engaging the latch to move same from engagement with the stop shoulder to permit opening of the door, the actuating means comprising a member having a base and side walls complementary in shape to the sides and the bottom of the access opening, the front of the base being adapted to engage the latch for pivoting the latch to a position freeing the latch from engagement with the stop shoulder and permitting the member to be inserted through the access opening into the baking chamber, while blocking the access opening so as to preclude entry of foreign objects into the baking chamber when the member is inserted into the baking chamber.

2. A heating appliance as in claim 1 wherein the door is slidably mounted on said wall for movement generally parallel to said wall to open and close said access opening, spring means mounted between said housing and said door for biasing said door toward the position closing said access opening.

3. A heating appliance as in claim 1 wherein the latch is secured to the door intermediate its upper and lower surfaces to enable pivoting of one of said surfaces relative to the stop shoulder.

4. A heating appliance as in claim 3 wherein said spring comprises a coil spring.

5. A heating appliance as in claim 1 wherein the member has a rear wall with projections thereon for contacting the face of said wall of housing.

6. A heating appliance as in claim 5 wherein said member has a handle thereon.

7. A heating appliance as in claim 6 wherein the base of said member is adapted to support material to be baked, whereby when the member is inserted through the access opening into the baking chamber, the door will contact the bottom of the base of said member and the member will substantially fill the access opening to preclude a user from putting an undesirable object, such as a finger, into the baking chamber.

8. A toy oven comprising a housing with a baking chamber defined therein, an access opening defined in a wall of the housing, said access opening having a top, a bottom and sides, an access door on the wall of said housing for normally blocking said access opening and being adapted to be moved to a position to unblock said access opening to permit access to said baking chamber, latching means for preventing inadvertent movement of the access door to open said access opening, said latching means comprising a latch pivotally secured on the access door and a stop shoulder on said housing adapted to be engaged by said latch to retain the access door in position blocking access to said baking chamber, a spring positioned between the latch and the access door for biasing the latch into engagement with the stop shoulder to preclude movement of the access door to unblock the access opening, and actuating means external of the housing for engaging the latch to release same from engagement with the stop shoulder to permit movement of the access door by the actuating means to open the access opening and enable the actuating means to enter the baking chamber, the actuating means comprising a member having a base and side walls complementary in shape to the sides and the bottom of the access opening, the base being adapted to support material to be baked, the front of the base being adapted to engage the latch for pivoting the latch to release the latch from the stop shoulder and permit the member to be inserted through the access opening into the baking chamber, while blocking the access opening to preclude entry of foreign objects into the baking chamber when the member is inserted fully into the baking chamber for baking the material on the member.

* * * * *